United States Patent [19]

Wheeler

[11] Patent Number: 4,572,227

[45] Date of Patent: Feb. 25, 1986

[54] HANDGRIP FOR A CRUTCH

[75] Inventor: William K. Wheeler, Amherst, N.H.

[73] Assignee: W. K. Wheeler, Inc., Amherst, N.H.

[21] Appl. No.: 656,765

[22] Filed: Oct. 1, 1984

[51] Int. Cl.[4] ..... A61H 3/02

[52] U.S. Cl. ..... 135/72; 16/110 R; 294/57

[58] Field of Search ..... 135/72, 73, 71, 68; 16/110 R, 111 R, 111 A, 112, 113, 114 R; 294/57, 58

[56] References Cited

U.S. PATENT DOCUMENTS

| | | | |
|---|---|---|---|
| 245,818 | 8/1881 | Groom | 294/57 |
| 705,741 | 7/1902 | Drew | 135/72 X |
| 2,856,943 | 10/1958 | Sparlin | 135/72 X |
| 3,269,399 | 8/1966 | Smith | 135/72 |
| 3,517,678 | 6/1970 | Gilsdorf | 135/72 |

FOREIGN PATENT DOCUMENTS

| | | | |
|---|---|---|---|
| 2310986 | 9/1974 | Fed. Rep. of Germany | 135/72 |
| 111755 | 12/1917 | United Kingdom | 135/72 |

*Primary Examiner*—Robert A. Hafer
*Assistant Examiner*—Arnold W. Kramer
*Attorney, Agent, or Firm*—Robert T. Gammons

[57] ABSTRACT

A handgrip for a crutch having spaced, parallel, generally-vertical anterior and posterior supports, comprising a rigid structure defining a hand supporting surface contoured to accommodate substantially the entire planar surface of the hand and peripherally thereof an integral dependent stiffening flange dimensioned to enable gripping the hand support, the flange being provided with a recess for non-rotatably receiving the anterior support and a bolt for rotatably securing the structure to the posterior and anterior supports to on the one hand secure the structure in a substantially horizontal position for use and on the other hand to permit the structure to be rotated to a generally vertical position for storage.

3 Claims, 9 Drawing Figures

HANDGRIP FOR A CRUTCH

BACKGROUND OF THE INVENTION

In U.S. Pat. No. 3,517,678 granted to Gilsdorf June 30, 1970, there is shown a handgrip for a crutch adapted to be mounted between spaced, parallel, generally vertical anterior and posterior supports of a crutch and provided with a hand-supporting surface contoured to accommodate substantially the entire planar surface of the hand. The handgrip therein illustrated is structured at its posterior side to provide a recess of rectangular cross section for non-rotatably receiving one of the crutch supports, has a transverse planar surface contoured to accommodate substantially the entire planar surface of the hand and is of solid block-like construction. The contoured hand-supporting surface shown therein is entirely satisfactory from the standpoint of providing a supporting surface for the hand; however, the structure as configured can only be used with a crutch wherein the supports are of rectangular cross section. The patented structure has the disadvantage that it is solid and, therefore, does not provide for gripping, is wasteful of material, and, finally, is not so structured as to enable disposing it in a nested position between the supports when the crutch is not in use. It is the purpose of this invention to overcome these disadvantages by so structuring the grip that it can be used with crutches having supports of rectangular or circular cross section, to reduce the cost by recessing its underside so as to economize in the amount of material used in its manufacture, to provide for better grasping of the structure, and to so mount the structure as to enable fixing it in a horizontal position for use and rotating it to a vertical nested position for non-use.

SUMMARY OF THE INVENTION

A handgrip for a crutch embodying spaced, parallel, generally vertical anterior and posterior supports, comprising a rigid structure defining a hand-supporting surface contoured to accommodate substantially the entire planar surface of the hand and peripherally thereof an integral depending stiffening flange of a depth corresponding substantially to the length of the second phalanxes of the fingers such that the first phalanxes of the fingers can be curled about the lower edge of the flange to enable gripping the handgrip and means associated with the flange at the anterior and posterior sides of the structure for on the one hand securing the structure between the anterior and posterior sides with the top side fixed in a substantially horizontal position for use and on the other hand in a generally vertical nested position for storage. The last-named means comprises in part a recess in the flange at the anterior side structured to non-rotatably receive the anterior support and means for releasably securing the recessed portion of the flange at the posterior side to said posterior support. The recess at the posterior side may be of rectangular horizontal section, arcuate horizontal section or a combination of rectangular and arcuate horizontal cross sections and the anterior side in each instance is desirably flat. The means for releasably securing the recessed portion of the flange comprises a bolt extending through the anterior and posterior supports and through the anterior and posterior flanges situated therebetween.

The invention will now be described in greater detail with reference to the accompanying drawings, wherein.

Figure 1:
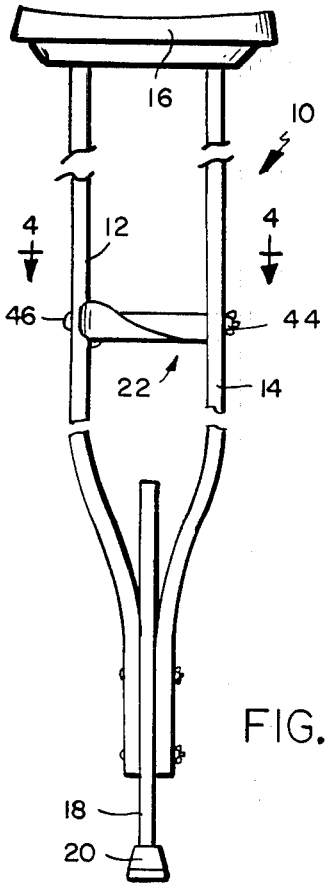
FIG. 1 is an elevation of a crutch provided with a hand support shown in its horizontal position.

The handgrip of this invention is structured to be used with a crutch 10 of the kind comprising spaced, parallel, generally vertical supports 12 and 14, to the upper ends of which is secured an underarm rest 16 and to the lower ends of which is secured a vertically-adjustable leg support 18 having at its lower end a foot pad 20. The supports 12 and 14 in one form are of rectangular horizontal section, FIG. 4, and in another form, FIG. 5, are of circular horizontal section and, in either case, may be comprised of wood, metal or plastic. A hand support indicated at 22 is secured between the supports 12 and 14 in such a way as to be vertically adjustable as will be described hereinafter.

The hand support 22 is a rigid structure having an upwardly-facing surface 24 contoured to accommodate substantially the entire palmar surface of the hand. The surface contour 24 of the hand support 22 corresponds in configuration to that shown in FIG. 2 of U.S. Pat. No. 3,517,678 and embodies all of the beneficial characteristics of the support shown and claimed therein.

Figure 4:
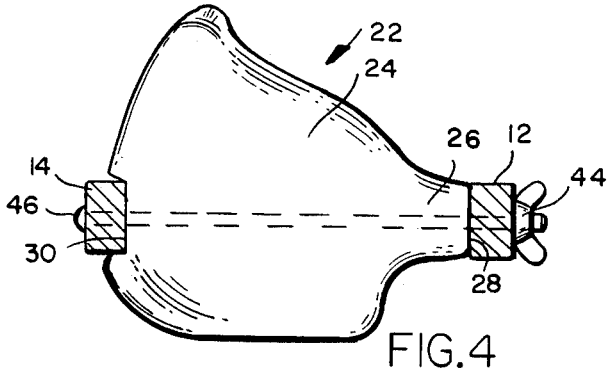
FIG. 4A is a plan view taken on the line 4—4 of FIG. 1 showing the hand support in one form.
Figure 5:
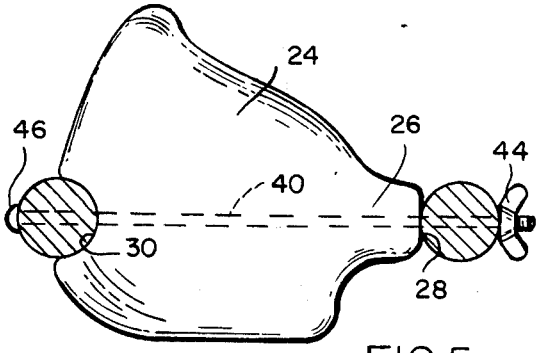
FIG. 5 is a plan view showing the hand support in another form.
Figure 6:
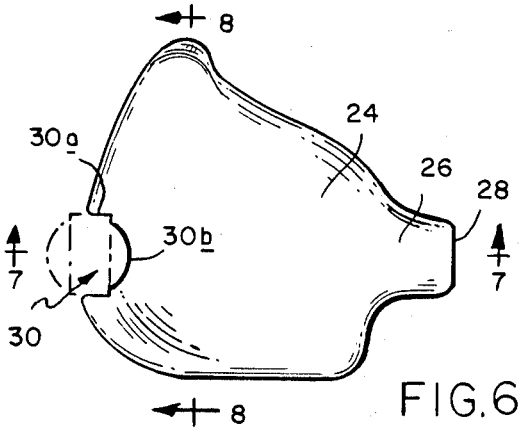
FIG. 6 is a plan view showing the hand support in still another form.

In one form, FIG. 4, the structure has at its posterior side a projection 26 defining a flat surface 28 and at its anterior side a recess 30 of rectangular cross section which, respectively, provides for engagement with the posterior and anterior supports 12 and 14. In another form, FIG. 5, the structure has a projection 26 defining a flat surface 28 and at its anterior side a recess 30 of arcuate cross section for engagement, respectively, with the posterior and anterior supports of circular cross section. In a third form, FIG. 6, the structure has a projection 26 defining a flat surface 28 and at its anterior side a recess 30 which embodies both rectangular and arcuate sections **30*a* and 30*b***.

The several structures provide for a crutch wherein the supports 12 and 14 are of rectangular cross section or of circular cross section or wherein the supports 12 and 14 are either of rectangular section or circular cross section.

Figure 7:
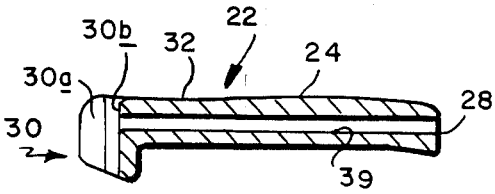
FIG. 7 is a section taken on the line 7—7 of FIG. 6.
Figure 8:
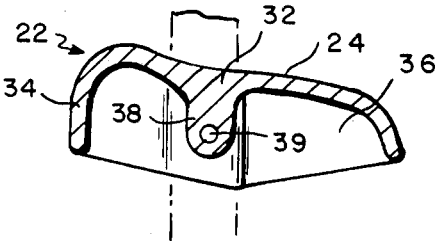
FIG. 8 is a section taken on the line 8—8 of FIG. 6.

Unlike the support structure shown in the aforesaid patent which is formed of a solid block of wood or plastic, the structure of the instant invention, FIGS. 7 and 8, is generally hollow and comprises a rigid top part 32 embodying the surface 24 and peripherally thereof a downwardly-extending flange 34 which provides reinforcement for the top part 32 and which embodies the flat surface 28 at the anterior side and the recess or recesses at the posterior side. Desirably, the depth of the flange 34 corresponds substantially to the length of the phalanxes of the second joints of the fingers so that when the hand is placed on the supporting surface 24, the fingers may be curled around the lower edge of the flange to obtain a secure grip. The flange 34 defines at the underside of the structure a recess 36 and within the recess extending from the posterior to the anterior side, there is a stiffening rib 38 defining a passage 39 extending from the posterior side to the anterior side and through the surface 28 at the posterior side and into the recess 30 at the anterior side. The passage is dimensioned to receive a mounting bolt 40 by means of which the structure is secured between the anterior and posterior supports 12 and 14.

Figure 2:
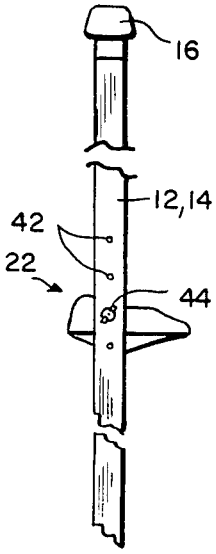
FIG. 2 is a fragmentary side view of FIG. 1 with the hand support in its horizontal position.

As shown in FIG. 2, the anterior and posterior supports 12 and 14 contain vertically-spaced holes 42 to enable mounting the structure at several different heights to accommodate the needs of the user.

Figure 3A:
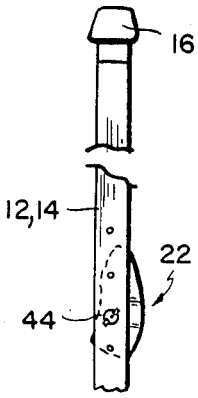
FIG. 3A is a fragmentary side elevation showing the hand support nested between the supporting structures.
Figure 3B:
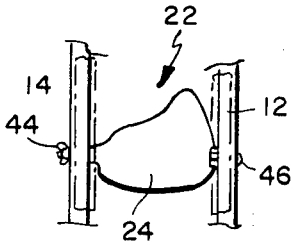
FIG. 3B is a fragmentary portion as seen from the right-hand side of FIG. 3A.

In the aforesaid Gilsdorf patent, the structure is shown as being rigidly attached to the posterior and anterior supports with the supporting surface 24 in a horizontal position substantially at right angles to the posterior and anterior supports. This has the disadvantage that it is not only difficult to ship crutches equipped with the hand support, but also to store crutches. In accordance with this invention, the mounting bolt 40 is dimensioned so that the structure can be secured in a horizontal position, FIG. 2, for use and can be rotated about the axis of the bolt to a vertical position, FIG. 3, in which the opposite sides are substantially parallel to the posterior and anterior supports, thus making it possible to store the crutches. This is achieved by making the securing bolt 40 long enough so that the nut 44 at the end opposite the head 46 can be unscrewed far enough to enable rotating the structure 22 between the fore and aft supports without releasing it to the vertical position proposed. To enable rotation from the horizontal position, the bolt 40 must be somewhat longer than the normal distance between the supports 12 and 14 so that the latter can be distended relative to each other to accommodate the anterior to posterior dimension of the structure. The supports 12 and 14 are necessarily elastic enough to be spread apart by rotation of the structure 22 when the nut 24 is backed off, the bolt must be long enough so that the nut can be backed off without releasing the bolt and, desirably, the corners of the recess should be blunted to aid in camming the supports away from each other as the structure is rotated from its horizontal to its vertical position.

Desirably, the structure 22 is comprised of plastic so that it can be molded to the configuration desired by suitable molding procedures; however, it is within the scope of the invention to form the structure of wood or metal.

Further, while the structure illustrated herein corresponds to FIG. 2 of the Gilsdorf patentl it may also have the configuration of FIG. 1 of the Gilsdorf patent.

It should be understood that the present disclosure is for the purpose of illustration only and includes all modifications or improvements which fall within the scope of the appended claims.

What is claimed is:

1. A handgrip for a crutch embodying spaced, parallel, generally vertical anterior and posterior supports, comprising a rigid hand support defining a hand supporting surface contoured to accommodate substantially the entire planar surface of the hand, said hand support having inner and outer sides and posterior and anterior ends, and peripherally thereof an integral depending stiffening flange of a depth corresponding substantially to the length of the second phalanx of the fingers such that the first phalanx can be curled about the lower edge of the flange to enable grasping the hand support and substantially medially of the inner and outer sides, an integral dependent reinforcing rib extending from the posterior side to the anterior side containing a through hole for receiving an attaching bolt for attaching the handgrip to the anterior and posterior supports of the crutch, said flange at the anterior side defining a substantially vertical planar surface and said flange at the posterior side containing a recess defined by spaced, parallel, vertically-disposed flat surfaces corresponding in depth to the depth of the flange and inwardly thereof an arcuate surface subtending the inner ends of the vertical surfaces of a depth corresponding to the depth of the flange, said planar surface and recess being located at the anterior and posterior ends of the stiffening rib such that the attaching bolt passes through the planar surface and through the recess, said planar surface and recess enabling the support to be applied to a crutch having supports of circular or rectangular cross section and providing for fixing the hand support in a horizontal position with the hand supporting surface uppermost for use and in a vertical position for storage.

2. A handgrip according to claim 1 wherein the lower edge of the flange is of arcuate cross section.

3. A handgrip according to claim 1 comprised of plastic.

* * * * *